US011694866B2

(12) United States Patent
Sakai et al.

(10) Patent No.: US 11,694,866 B2
(45) Date of Patent: Jul. 4, 2023

(54) ELECTRIC CIRCUIT BREAKER DEVICE

(71) Applicant: DAICEL CORPORATION, Osaka (JP)

(72) Inventors: Toshiyuki Sakai, Tokyo (JP); Tomohide Fujiwara, Tokyo (JP)

(73) Assignee: DAICEL CORPORATION, Osaka (JP)

( * ) Notice: Subject to any disclaimer, the term of this patent is extended or adjusted under 35 U.S.C. 154(b) by 176 days.

(21) Appl. No.: 17/431,976

(22) PCT Filed: Feb. 18, 2020

(86) PCT No.: PCT/JP2020/006353
§ 371 (c)(1),
(2) Date: Aug. 18, 2021

(87) PCT Pub. No.: WO2020/171086
PCT Pub. Date: Aug. 27, 2020

(65) Prior Publication Data

US 2022/0139653 A1 May 5, 2022

(30) Foreign Application Priority Data

Feb. 19, 2019 (JP) ..... 2019-027473

(51) Int. Cl.
*H01H 39/00* (2006.01)

(52) U.S. Cl.
CPC ..... *H01H 39/006* (2013.01)

(58) Field of Classification Search
CPC ..... H01H 39/00; H01H 39/006; H01H 2039/008
See application file for complete search history.

(56) References Cited

U.S. PATENT DOCUMENTS 5,990,572 A * 11/1999 Yasukuni ..... H01H 39/006 180/271
2002/0018331 A1* 2/2002 Takahashi ..... H01H 39/00 361/264

(Continued)

FOREIGN PATENT DOCUMENTS

JP 11-329190 A 11/1999
JP 2000-149747 A 5/2000

(Continued)

OTHER PUBLICATIONS

International Preliminary Report on Patentability and English translation of the Written Opinion of the International Searching Authority for International Application No. PCT/JP2020/006353, dated Aug. 10, 2021.

(Continued)

*Primary Examiner* — Jacob R Crum
(74) *Attorney, Agent, or Firm* — Birch, Stewart, Kolasch & Birch, LLP

(57) ABSTRACT

An electric circuit breaker device includes: an igniter; a projectile that is disposed in a movement path, the projectile formed to be movable by actuation of the igniter; and a conductor piece that forms one portion of a predetermined electric circuit, the conductor piece having both end portions connected to respective other portions of the predetermined electric circuit, the conductor piece having a first portion between both the end portions arranged to traverse the movement path. A sensor is connected to a first part positioned between both the end portions and to a second part that is between both the end portions and is different from the first part, the sensor configured to detect current flowing through the conductor piece between both the end portions, the sensor disposed to be integrated with the conductor (Continued)

piece. The actuation of the igniter is controlled, based on the current detected by the sensor.

3 Claims, 6 Drawing Sheets

(56) References Cited

U.S. PATENT DOCUMENTS

| | | | | |
|---|---|---|---|---|
| 2004/0041682 | A1 | 3/2004 | Pasha et al. | |
| 2008/0137253 | A1* | 6/2008 | George | H01H 39/006 29/428 |
| 2016/0204597 | A1 | 7/2016 | Hotta | |
| 2017/0221662 | A1 | 8/2017 | Sakai | |
| 2019/0206646 | A1 | 7/2019 | Yamada | |
| 2020/0279711 | A1* | 9/2020 | Mathieu | H01H 85/0039 |

FOREIGN PATENT DOCUMENTS

| | | | |
|---|---|---|---|
| JP | 2001-86637 | A | 3/2001 |
| JP | 2015-73398 | A | 4/2015 |
| JP | 2018-006082 | A | 1/2018 |
| JP | 6414816 | B2 | 10/2018 |

OTHER PUBLICATIONS

International Search Report for International Application No. PCT/JP2020/006353, dated Apr. 7, 2020.

* cited by examiner

ELECTRIC CIRCUIT BREAKER DEVICE

TECHNICAL FIELD

The present invention relates to an electric circuit breaker device that can be used in a predetermined electric circuit for a vehicle, electric home appliance, or the like.

BACKGROUND ART

An electric circuit may be provided with a breaker device configured to be actuated when an abnormality occurs in a device constituting the electric circuit or when an abnormality occurs in a system in which the electric circuit is mounted, thereby interrupting the continuity of the electric circuit. A breaker device for electrical continuity has been proposed in which, according to one aspect thereof, a projectile is moved at high speed by energy applied from an igniter or the like to forcibly and physically cut a conductor piece that forms one portion of the electric circuit.

For example, an electric circuit breaker device disclosed in Patent Document 1 has a housing made of synthetic resin accommodating an igniter, a projectile made of synthetic resin, and a conductor piece for forming one portion of an electric circuit. Furthermore, a cylinder made of metal is provided between the projectile and an inner wall surface of the housing to reinforce the housing. With the cylinder made of metal thus used for reinforcing the housing and protecting the housing from heat of a combustion product produced by the igniter, the housing can have a small thickness, whereby the electric circuit breaker device can be downsized.

CITATION LIST

Patent Document

Patent Document 1: JP 6414816 B

SUMMARY OF INVENTION

Technical Problem

The electric circuit breaker device is a device that, when excessive current flows in an electric circuit, physically cuts a part of the electric circuit to interrupt the continuity of the electric circuit, considering various matters related to safety in the electric circuit, and is an important part for maintaining the safety of the electric circuit. For electric circuit breaker devices in the related-art, a sensor for detecting excessive current is provided separately from the electric circuit breaker device. This hinders downsizing of the electric circuit breaker device itself, and may impose a problem in terms of safety design for an electric circuit.

On top of that, when the electric circuit breaker device and the sensor are separately provided as described above, current to be detected travels for a longer distance to be more susceptible to noise. This should not be regarded as a favorable condition for proper actuation of the electric circuit breaker device.

In view of the above problem, an object of the technique of the present disclosure is to provide a technique of enabling the downsizing of the electric circuit breaker device.

Solution to Problem

To solve the problem described above, the technique of the present disclosure employs a configuration of an electric circuit breaker device in which a sensor for detecting current is arranged to be integrated with a conductor piece forming one portion of a predetermined electric circuit. With such a configuration, downsizing of the electric circuit breaker device can be achieved.

Specifically, an electric circuit breaker device of the present disclosure includes: an igniter provided to a housing; a projectile that is disposed in a movement path formed in the housing, the projectile formed to be movable in the movement path by receiving energy from the igniter; a conductor piece that forms one portion of a predetermined electric circuit, the conductor piece having both end portions connected to respective other portions of the predetermined electric circuit, the conductor piece having a first portion between both the end portions arranged to traverse the movement path; an insulated space that is formed on a side opposite to the projectile with the conductor piece in-between before the igniter is actuated, the insulated space connected to the movement path; a sensor that is connected to a first part positioned between both the end portions and to a second part that is between both the end portions and is different from the first part, the sensor configured to detect current flowing through the conductor piece between both the end portions, the sensor disposed to be integrated with the conductor piece; and a control unit that controls actuation of the igniter, based on the current detected by the sensor.

In the electric circuit breaker device described above, when abnormality such as excessive current occurs in the predetermined electric circuit, the sensor detects such excessive current, and the conductor piece forming one portion of the predetermined electric circuit is cut, whereby safety is ensured. This predetermined electric circuit is an electric circuit the safety of which is required to be ensured by the electric circuit breaker device, and is not limited to a certain electric circuit. Examples of the electric circuit include a circuit connected to a battery of a vehicle (such as lithium ion battery) and various electric circuits for electric home appliances. The excessive current is current set considering the safety for each electric circuit, and is not based on any absolute value.

The conductor piece forming one portion of the electric circuit is incorporated as a part of the electric circuit breaker device. The conductor piece includes a first portion arranged to traverse the movement path in which the projectile moves. Thus, the projectile moves in the movement path upon receiving the combustion energy produced by the igniter actuated. With the first portion arranged to traverse the movement path, the projectile moving cuts the first portion off from the main body of the conductor piece. Thus, continuity in the predetermined electric circuit including the conductor piece is interrupted, whereby a risk due to the excessive current can be suppressed. The first portion cut off from the main body of the conductor piece moves in the insulated space together with the projectile, and may be isolated from the electric circuit in an electrically safe manner.

In the electric circuit breaker device described above, the sensor detects abnormal current in the predetermined electric circuit, that is, the excessive current flowing through the conductor piece. The sensor is electrically connected to the conductor piece via two parts, that is, the first part and the second part. Thus, current correlated with current flowing between the first part and the second part can be provided to the sensor side, whereby the magnitude of the current (current value) can be detected. The sensor is arranged to be integrated with the conductor piece. With such a configuration, downsizing of the electric circuit breaker device itself can be achieved. Thus, the electric circuit breaker device described above can be applied to a wider range of predetermined electric circuits, to have usability improved to a level unachievable by the related art. The configuration described above can achieve a shorter detected current traveling distance, and thus the detection of the excessive current is less susceptible to noise or the like, to be suitable for a proper operation of the electric circuit breaker device.

In the electric circuit breaker device described above, in the conductor piece, a second portion at least including a section between the first part and the second part may be formed of a predetermined metal other than copper, or may be formed of an alloy of copper and the predetermined metal, and a portion of the conductor piece other than the second portion may be formed of copper. Generally, copper is a metal that features relatively low electrical resistance and thus is widely adopted as a conductive member, but may involve a large fluctuation of electrical resistance of the member in response to a temperature rise as a result of conduction. Such a property of copper might adversely affect the current detection accuracy of the sensor. Thus, with the second portion of the conductor piece not formed of copper only, the impact on the current detection accuracy of the sensor can be suppressed. The portion of the conductor piece other than the second portion, unrelated to the current detection by the sensor, is formed of copper. Thus, the electrical resistance of the conductor piece can be lowered, whereby effective conduction can be achieved.

In the electric circuit breaker device described above, the first portion may be included in a section between both the end portions and between the first part and the second part. Specifically, a region of detection by the sensor and a region cut by the projectile overlap. Thus, the electric circuit breaker device can be downsized. The region between the first part and the second part is included in the second portion. In particular, when the second portion is formed to include a material other than copper as described above, the first portion to be cut by the projectile is favorably cut without being unintentionally extended due to the physical properties of the first portion included in the second portion. In particular, unintentional extension of the first portion with the excessive current detected results in generation of an arc. Thus, with the first portion cut as described above, arc extinguishing performance related to current breaking can be improved.

Advantageous Effects of Invention

With the present disclosure, the electric circuit breaker device can be favorably downsized.

DESCRIPTION OF EMBODIMENTS

An electric circuit breaker device according to a technique of the present disclosure will be described below with reference to the drawings. Note that, configurations of the following embodiments are provided as examples, and the present disclosure is not limited to the configurations of the embodiments.

Example 1

Figure 1A:
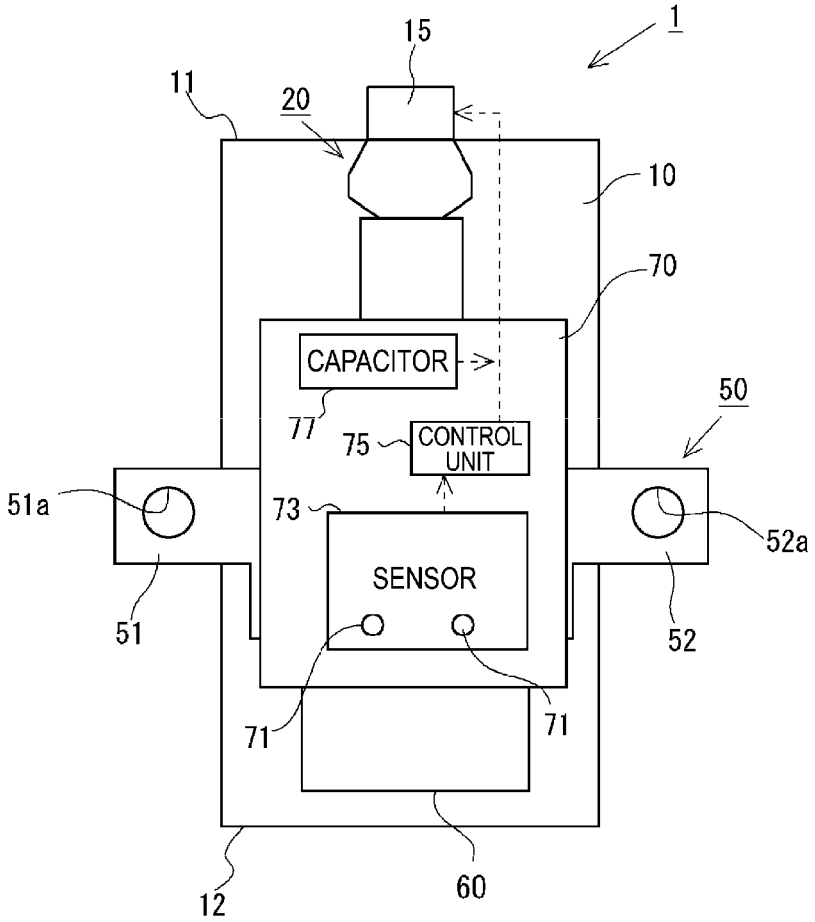
FIG. 1A is a diagram illustrating a schematic configuration of an electric circuit breaker device according to an embodiment.
Figure 1B:
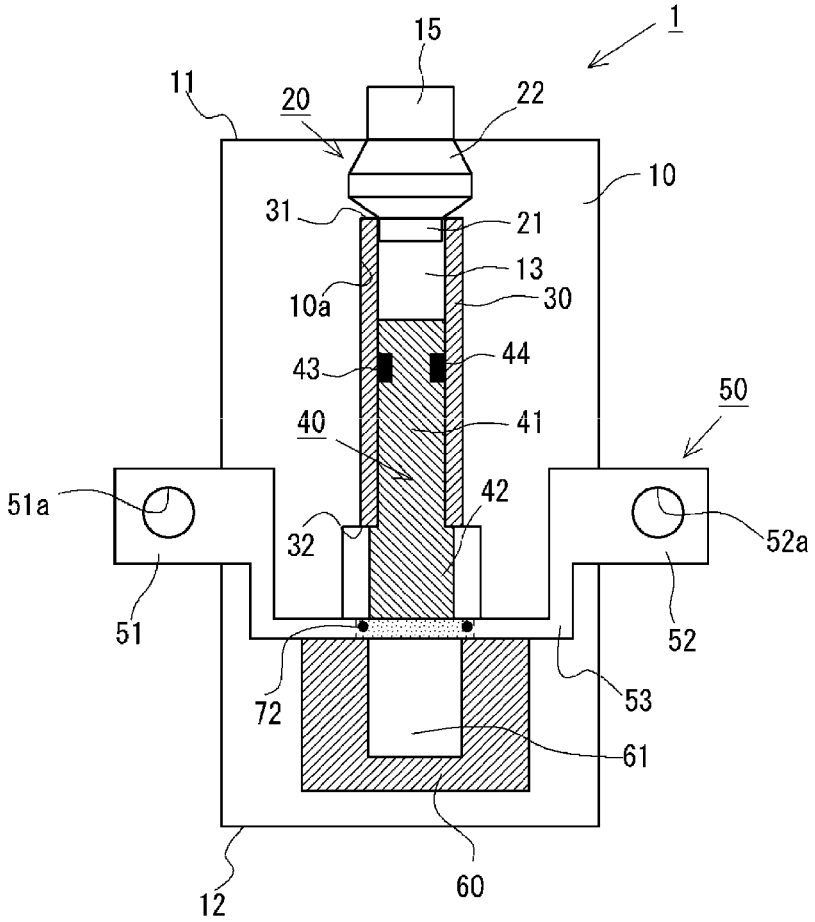
FIG. 1B is a diagram illustrating a cross-section of the electric circuit breaker device according to the embodiment.
Figure 2:
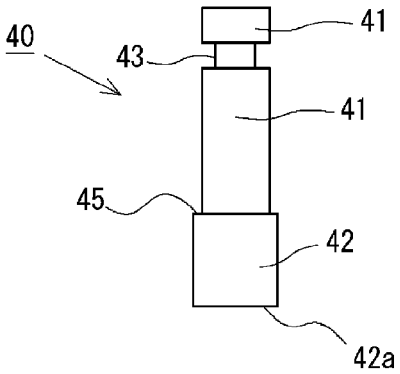
FIG. 2 is a diagram illustrating a configuration of a projectile included in the electric circuit breaker device according to the embodiment.
Figure 3:
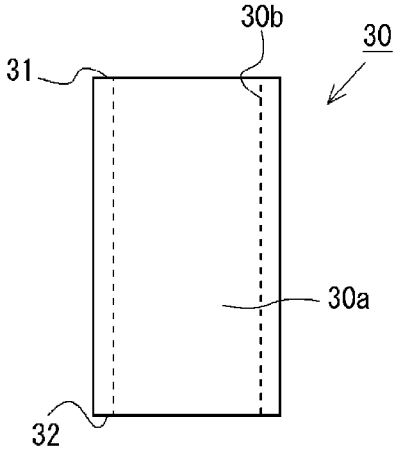
FIG. 3 is a diagram illustrating a configuration of a cylinder included in the electric circuit breaker device according to the embodiment.

FIG. 1A is a diagram illustrating a schematic configuration of an electric circuit breaker device (hereinafter, simply referred to as "breaker device") 1. FIG. 1B is a cross-sectional view of the breaker device 1 taken along a longitudinal direction (direction in which a cylindrical space 13 described later extends). Also, FIGS. 2, 3, and 4 respectively illustrate configurations of a projectile 40, a cylinder 30, and a conductor piece 50 included in the breaker device 1.

A housing 10 made of a synthetic resin includes the cylindrical space 13 that extends in a direction from a first end portion 11 to a second end portion 12. This cylindrical space 13 is a space formed in a straight line, making the projectile 40 described later movable. On the first end portion 11 side of the breaker device 1, a connector 15 connected to a power source during its use is attached.

In the cylindrical space 13 of the housing 10, an igniter 20, the projectile 40 made of a synthetic resin, and the conductor piece 50 are disposed in this order along the longitudinal direction of the breaker device 1 from the first end portion 11 side. The igniter 20 includes an ignition portion 21 and a resin portion 22 in which a portion of an igniter body is surrounded by a resin, and the ignition portion 21 is arranged to be exposed to the cylindrical space 13 from the resin portion 22. Thus, a combustion product produced by the igniter 20 actuated is discharged into the cylindrical space 13.

Here, before the breaker device 1 is actuated, the projectile 40 is disposed within the cylindrical space 13 as illustrated in FIG. 1B. Under this condition, the lower side in FIG. 1B is defined as a distal end side of the projectile 40 and the upper side in FIG. 1B is defined as a proximal end side of the projectile 40. In this state before the actuation, an end surface of the projectile 40 on the proximal end side is arranged to face the ignition portion 21 of the igniter 20.

The projectile 40 includes a rod-shaped rod portion 41 and an end increased diameter portion 42 formed on the distal end side of the rod portion 41. The end increased diameter portion 42 has an outer diameter that is larger than the outer diameter of the rod portion 41, and thus an annular step surface 45 (see FIG. 2) is formed at a boundary portion between the rod portion 41 and the end increased diameter portion 42. A cross-sectional shape of the rod portion 41 in the width direction is circular, and a cross-sectional shape of the end increased diameter portion 42 in the width direction is rectangular (preferably a square) or circular. However, the cross-sectional shapes of the rod portion 41 and the end increased diameter portion 42 are not limited to these shapes. The rod portion 41 includes a recessed portion 43 having a partially reduced outer diameter. An O-ring 44 made of rubber (for example, silicone rubber) or synthetic resin is fit to the recessed portion 43. When the O-ring 44 is fit to the recessed portion 43, in a state of not being disposed in the cylindrical space 13, an outer diameter of the portion of the O-ring 44 slightly larger than the outer diameter of the rod portion 41. Thus, when the projectile 40 to which the O-ring 44 is fit is disposed in the cylindrical space 13, favorable sealing is achieved by the O-ring 44, whereby effective driving of the projectile 40 is achieved.

In the breaker device 1, the cylinder 30 is provided in the housing 10, and the cylindrical space 13 described above is formed by the cylinder 30. Specifically, the housing 10 has an internal space formed therein, where the cylinder 30 is fixedly press fit to be unmovable with respect to the housing 10 in the axial direction. A claw portion may be formed on an outer surface 30*a* of the cylinder 30 and a dent portion corresponding to the claw portion may be formed on an inner wall surface 10*a*, of the internal space in the housing 10, facing the claw portion in a radial direction, and the claw portion may be fit in the dent portion at the time of attachment, to make the cylinder 30 fixed to be unmovable in the axial direction.

The cylinder 30 is for reinforcing the housing 10 and is made of metal such as stainless steel or iron. A thickness of the cylinder 30 varies depending on the size of the breaker device 1 and is preferably in a range from 0.5 to 3 mm for example. With this configuration, the following effects are expected to be obtained.

First Advantageous Effect

With the housing 10 reinforced using the cylinder 30 made of metal, the housing 10 can have a small thickness, whereby the breaker device 1 can be downsized.

Second Advantageous Effect

The combustion product produced by the actuation of the igniter 20 travels in the cylinder 30 and impacts on the projectile 40, and thus the inner wall surface 10*a* of the housing 10 would not be directly exposed to heat and pressure of the combustion product. As a result, the housing can have a small thickness, contributing to the downsizing of the breaker device 1 in addition to the first advantageous effect.

Third Advantageous Effect

The cylinder 30 serves as the passage of the combustion product produced by the igniter 20 actuated to enable the entirety of the combustion product to impact with the projectile 40, and serves as a guide portion when the projectile 40 moves.

The cylinder 30 includes a first end opening portion 31 that is in contact with the resin portion 22 of the igniter 20 and a second end opening portion 32 on the opposite side that is in contact with the annular step surface 45 of the projectile 40 before the breaker device 1 is actuated. The cylinder 30 is arranged surrounding the ignition portion 21 of the igniter 20 and the rod portion 41 of the projectile 40. In this state, the O-ring 44 fit to the recessed portion 43 of the projectile 40 is in contact with an inner circumference surface 30*b* of the cylinder 30, and the outer surface of the rod portion 41 and the inner circumference surface 30*b* of the cylinder 30 are not completely in contact with each other. Specifically, the dimensions and the shapes of the cylinder 30 and the projectile 40 are determined, to enable the rod portion 41 which is a part of the projectile 40 to move in the cylindrical space 13 formed in the cylinder 30.

Figure 4:
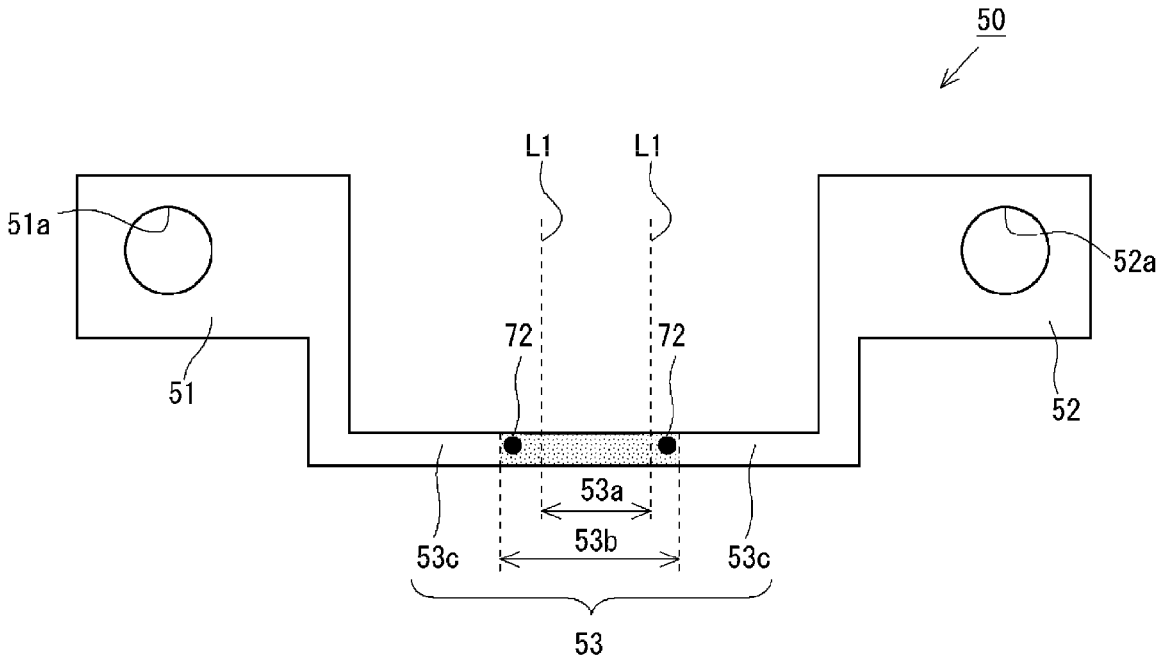
FIG. 4 is a diagram illustrating a configuration of a conductor piece included in the electric circuit breaker device according to the embodiment.

Next, the conductor piece 50 will be described. The conductor piece 50 is for forming one portion of a predetermined electric circuit when the breaker device 1 is attached to the electric circuit. The conductor piece 50 is a plate-shaped piece including a first end portion 51 and a second end portion 52 on both end sides, as well as an intermediate portion 53 between both the end portions. A hole 51*a* of the first end portion 51 and a hole 52*a* of the second end portion 52 are two holes for establishing connection with other conductors (lead wire for example) in the predetermined electric circuit. The conductor piece 50 illustrated in FIGS. 1B and 4 is formed to have a surface of the intermediate portion 53 (a planer portion of the plate-shaped piece) and surfaces of the first end portion 51 and the second end portion 52 (planer portions of the plate-shaped piece) arranged orthogonal to each other. Alternatively, the surface of the intermediate portion 53 and the surfaces of the first end portion 51 and the second end portion 52 may form a single surface. The conductor piece 50 may have a portion of the first end portion 51 near the intermediate portion 53; and a portion of the second end portion 52 near the intermediate portion 53, both of which are deformed in the thickness direction according to the shape and structure of an attaching portion of the housing 10.

The conductor piece 50 is disposed with a surface of the intermediate portion 53 orientated orthogonal to the extending direction of the cylindrical space 13. As a result, the drive direction of the projectile 40 that moves in the cylindrical space 13 and the surface of the intermediate portion 53 are in an orthogonal positional relationship. The surface of the intermediate portion 53 of the conductor piece 50 faces an end surface 42*a* of the end increased diameter portion 42 of the projectile 40. Thus, the intermediate portion 53 of the conductor piece 50 is in a state of being disposed to traverse the space in the housing 10 in which the projectile 40 moves. Note that in FIG. 1B, the surface of the intermediate portion 53 and the end surface 42*a* of the projectile 40 are in contact with each other, but they may be arranged to face each other with a gap provided in-between.

When the end increased diameter portion 42 of the projectile 40 has a square cross-sectional shape in the width direction, a length (L) of one side and a width (W) of the intermediate portion 53 of the conductor piece 50 preferably satisfy the relationship $L \geq W$, and more preferably are in a range of $L/W=1.0$ to 1.2. With this configuration, the intermediate portion 53 of the projectile 40 may be preferably cut.

A stopper 60 of a box shape with one surface open is provided between the conductor piece 50 and the second end portion 12 of the housing 10, with the opening portion side facing the conductor piece 50 side. The stopper 60 is made of synthetic resin which is a favorable insulation material, and thus has an insulated space 61 formed therein, where a certain level of insulation against the conductor piece 50 is ensured. When the breaker device 1 is actuated, the end increased diameter portion 42 of the projectile 40 moves in the longitudinal direction to cut the intermediate portion 53 of the conductor piece 50. Then, the end increased diameter portion 42 and a cut piece of the intermediate portion 53 enter the insulated space 61. Thus, interruption of the continuity of a predetermined electric circuit is safely achieved through cutting of the intermediate portion 53.

Furthermore, the breaker device 1 of the present embodiment has a sensor 73 that detects current flowing in the conductor piece 50, incorporated to be integrated with the conductor piece 50 as illustrated in FIG. 1A. Specifically, a controller 70 including: the sensor 73, a control unit 75 for controlling the actuation of the igniter 20, and a capacitor 77 is incorporated in the breaker device 1. In addition to the current flowing through the conductor piece 50, the sensor 73 may be capable of detecting a voltage and a temperature of the conductor piece 50. The control unit 75 is a computer capable of performing a predetermined function by executing a predetermined control program. The predetermined function of the control unit 75 may be realized by corresponding hardware. The capacitor 77 is configured to store a part of the current flowing through the conductor piece 50 under a normal condition (with no excessive current flowing).

As illustrated in FIG. 4, the portion of the intermediate portion 53 of the conductor piece 50 that is cut by the end increased diameter portion 42 of the projectile 40 is referred to as a first portion 53*a*. A dashed line L1 illustrated in FIG. 4 indicates a position corresponding to the outer contour of the end increased diameter portion 42 in the state illustrated in FIG. 1B. Two terminals 72 through which a part of the current flowing through the conductor piece 50 is provided to the sensor 73 are provided at both outer sides of the first portion 53*a*. A position of one of the two terminals 72 (the position of the left side terminal 72 illustrated in FIG. 4 for example) is defined as a first part, and a position of the other one (the position of the right side terminal 72 illustrated in FIG. 4 for example) is defined as a second part. Thus, a positional relationship is established in which the first portion 53*a* to be cut by the projectile 40 is included in a section between the first part and the second part. The controller 70 is attached to the conductor piece 50 using these two terminals 72, with the attachment position denoted by "71" in FIG. 1A.

A portion of the intermediate portion 53 at least including the section between the first part and the second part is defined as a second portion 53*b*. Thus, a positional relationship is established in which the second portion 53*b* includes the two terminals 72 and the first portion 53*a* cut by the projectile 40. A portion of the intermediate portion 53 excluding the second portion is denoted by "53*c*" in FIG. 4.

In the conductor piece 50, the second portion 53*b* at least including the section between the first part and the second part where the two terminals 72 are provided is formed of a predetermined metal other than copper (Cu), or is formed of an alloy of copper and the predetermined metal. Generally, copper is a metal material that features relatively low electrical resistance enabling conduction with a small amount of heat produced, but involves a large fluctuation of the electrical resistance once the heat is produced. Thus, the second portion 53*b* including the section between the two terminals 72 related to the detection of the current by the sensor 73 is formed without including copper or to include the predetermined metal other than copper as described above. Thus, the current detection accuracy of the sensor 73 can be prevented from being compromised. Note that examples of the predetermined metal include manganese (Mn), nickel (Ni), and platinum (Pt). The second portion 53*b* is a region including the first portion 53*a* cut by the projectile 40. With this region formed without including copper or to include the predetermined metal other than copper as described above, unintentional extension of the conductor piece 50 at the time of cutting can be suppressed, whereby arc suppression at the time of cutting can be achieved and thus arc extinguishing performance can be improved.

A portion of the conductor piece 50 other than the second portion 53*b*, that is, a portion 53*c* which is a part of the intermediate portion 53 and the first end portion 51 and the second end portion 52 are formed of copper. Thus, efficient conduction of the conductor piece 50 can be guaranteed.

Alternatively, the conductor piece 50 may be entirely formed of copper only. With such a configuration, the electrical resistance of the conductor piece 50 as a whole can be favorably lowered, whereby efficient conduction is achieved.

With the breaker device 1 with such a configuration, the cylinder 30 made of metal is disposed in the housing 10 to reinforce the housing 10, and thus the housing 10 can have a small thickness, whereby the breaker device 1 can be downsized. For example, with the breaker device 1, the thickness of the housing 10 can be reduced by from 30 to 80% compared to a case where the cylinder 30 is not used.

When excessive current flows through the conductor piece 50 forming a predetermined electric circuit, such current is detected by the sensor 73. The current detected travel from the sensor 73 to the control unit 75. The control unit 75 controls the actuation of the igniter 20 based on the value of the current thus detected. In this case, the control unit 75 actuates the igniter 20 using the energy stored in the capacitor 77. For example, when the current value detected exceeds a predetermined threshold set for protecting the predetermined electric circuit, the control unit 75 actuates the igniter 20 using the energy in the capacitor 77. Thus, the breaker device 1 is what can be regarded as a self-contained breaker device configured to be capable of actuating the igniter 20 without being supplied with energy from the outside of the device, in response to the excessive current flowing. As a result, a combustion product is generated from the ignition portion 21 of the igniter 20, and the combustion energy thereof is transmitted to the projectile 40. Then, the projectile 40 moves in the extending direction of the cylindrical space 13, and the end increased diameter portion 42 cuts the first portion 53*a* included in the intermediate portion 53 of the conductor piece 50. Then, the end increased diameter portion 42 and the cut piece of the first portion 53*a* move into the insulated space 61 to be held electrically insulated. Through this operation, the first end portion 51 and the second end portion 52 on both ends of the conductor piece 50 are electrically disconnected, so the predetermined electric circuit on which the breaker device 1 is disposed is broken.

In the breaker device 1, the controller 70 including the sensor 73 is disposed to be integrated with the conductor piece 50 via the two terminals 72. With this configuration, a shortest possible distance between the conductor piece 50 and the sensor 73 in which the current to be detected by the sensor 73 travels can be achieved, whereby the breaker device 1 can be downsized. The breaker device 1 thus downsized can be used for a wider range of applications, to be more useful to easily achieve the safety design of the predetermined electric circuit. With the conductor piece 50 and the sensor 73 integrated, the current can travel by a shorter distance to be less susceptible to noise.

Modified Examples

Figure 5:
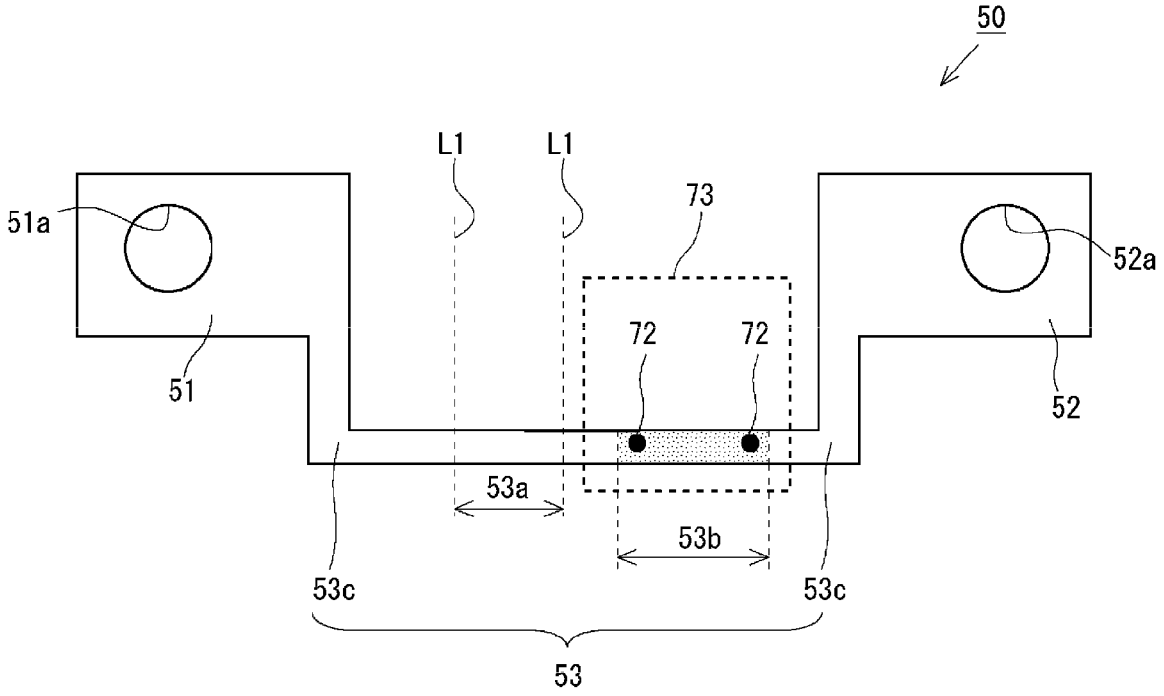
FIG. 5 is a diagram illustrating correlation between the conductor piece and a sensor included in the electric circuit breaker device according to a modification of the embodiment.

Instead of the mode of the embodiment described above, a mode may be employed that is obtained by changing the relationship between the relative position of the sensor 73 relative to the conductor piece 50 and the relative positions of the cylindrical space 13 and the projectile 40 driven therein, to prevent the part (that is, between the first part and the second part) of the conductor piece 50 where the current to be detected by the sensor 73 flows and the first portion 53*a* to be cut from overlapping with each other. For example, in the breaker device 1 of the present modification, the sensor 73 detecting the current flowing through the conductor piece 50 and the conductor piece 50 are integrated and incorporated, without the first portion 53*a* and the second portion 53*b* overlapping with each other in the intermediate portion 53 of the conductor piece 50 as illustrated in FIG. 5. Here, a region corresponding to the second portion 53*b* at least including the section between the first part and the second part is preferably formed without including copper or to include a predetermined metal other than copper as described above. Still, the conductor piece 50 as a whole including the region may be formed of copper only.

REFERENCE SIGNS LIST

1 Breaker device
10 Housing
13 Cylindrical space
20 Igniter
30 Cylinder
40 Projectile
50 Conductor piece
53 Intermediate portion
53*a* First portion
53*b* Second portion
60 Stopper
61 Insulated space
70 Controller
72 Terminal
73 Sensor
75 Control unit
77 Capacitor

The invention claimed is:

1. An electric circuit breaker device comprising:

an igniter provided to a housing;

a projectile that is disposed in a movement path formed in the housing, the projectile formed to be movable in the movement path by receiving energy from the igniter;

a conductor piece that forms one portion of a predetermined electric circuit, the conductor piece having two end portions connected to respective other portions of the predetermined electric circuit, the conductor piece having a first portion between both the end portions arranged to traverse the movement path;

an insulated space that is formed on a side opposite to the projectile with the conductor piece in-between before the igniter is actuated, the insulated space connected to the movement path;

a sensor that is connected to a first part positioned between both the end portions and to a second part that is between both the end portions and is different from the first part, the sensor configured to detect current flowing through the conductor piece between both the end portions, the sensor disposed to be integrated with the conductor piece; and a control unit that controls actuation of the igniter, based on the current detected by the sensor.

2. The electric circuit breaker device according to claim 1, wherein in the conductor piece, a second portion at least including a section between the first part and the second part is formed of a predetermined metal other than copper or is formed of an alloy of copper and the predetermined metal, and a portion of the conductor piece other than the second portion is formed of copper.

3. The electric circuit breaker device according to claim 1, wherein the first portion is included in a section between both the end portions and between the first part and the second part.

* * * * *